US008044896B2

(12) United States Patent
Tsai

(10) Patent No.: US 8,044,896 B2
(45) Date of Patent: Oct. 25, 2011

(54) ORGANIC ELECTROLUMINESCENT DISPLAY AND PIXEL DRIVING CIRCUIT THEREOF FOR REDUCING THE KINK EFFECT

(75) Inventor: Tze-Chien Tsai, Taipei Hsien (TW)

(73) Assignee: Au Optronics Corp., Hsinchu (TW)

( * ) Notice: Subject to any disclaimer, the term of this patent is extended or adjusted under 35 U.S.C. 154(b) by 839 days.

(21) Appl. No.: 11/438,353

(22) Filed: May 23, 2006

(65) Prior Publication Data

US 2007/0046588 A1 Mar. 1, 2007

(30) Foreign Application Priority Data

Aug. 30, 2005 (TW) ..... 94129760 A

(51) Int. Cl.
*G09G 3/32* (2006.01)

(52) U.S. Cl. ..... 345/82

(58) Field of Classification Search ..... 345/36, 345/39, 44–46, 76–83; 315/169.3; 313/463
See application file for complete search history.

(56) References Cited

U.S. PATENT DOCUMENTS 6,091,203 A * 7/2000 Kawashima et al. ..... 315/169.3
6,509,692 B2 * 1/2003 Komiya ..... 315/169.3
7,502,002 B2 * 3/2009 Horiuchi et al. ..... 345/82
2002/0101177 A1 * 8/2002 Bae et al. ..... 315/169.3
2002/0196212 A1 * 12/2002 Nishitoba et al. ..... 345/76
2004/0189615 A1 * 9/2004 Osame et al. ..... 345/173

* cited by examiner

*Primary Examiner* — Chanh Nguyen
*Assistant Examiner* — Ram Mistry
(74) *Attorney, Agent, or Firm* — Birch, Stewart, Kolasch & Birch, LLP

(57) ABSTRACT

A pixel driving circuit includes a first transistor, a second transistor, a third transistor, a forth transistor, a switching circuit, a first voltage generator, a second voltage generator, and a light emitting element. The source of the first transistor is electrically connected to the drain of the second transistor. The gate of the third transistor is electrically connected to the gate of the first transistor. The drain of the forth transistor is electrically connected to the source of the third transistor, and the gate of the forth transistor is electrically connected to the gate and the drain of the second transistor. The first voltage generator is coupled to the source of the second transistor and of the forth transistor. The light emitting element is coupled to the drain of the first transistor via a first electrode, and to the second voltage generator via a second electrode. The switching circuit is electrically connected to the drain and the gate of the third transistor.

1 Claim, 6 Drawing Sheets

ORGANIC ELECTROLUMINESCENT DISPLAY AND PIXEL DRIVING CIRCUIT THEREOF FOR REDUCING THE KINK EFFECT

This application claims the benefit of Taiwan Patent Application Serial No. 094129760, filed Aug. 30, 2005, the subject matter of which is incorporated herein by reference.

BACKGROUND OF THE INVENTION (1) Field of the Invention

The present invention relates to a driving circuit of a pixel of an active display, and the driving circuit is capable of reducing the kink effect.

(2) Description of the Prior Art

An active matrix organic electroluminescent display (AMOLED) employs organic light emitting diodes (OLEDs) as light source, and thin film transistors (TFT) as switch or driver. The brightness of the organic light emitting diode is controlled by the current density. The current density of the organic light emitting diode is affected by the drain current of the thin film transistor, because the organic light emitting diode is usually connected to the drain electrode of the thin film transistor. However, the drain current is often influenced by the threshold voltage drift and the kink effect of the thin film transistor.

In an ideal case, the drain current ($I_D$) is independent of the voltage ($V_{DS}$) between the drain electrode and the source electrode. However, when the voltage ($V_{DS}$) is larger than the pinched-off voltage, a depletion region is formed in the interface between the channel and the drain electrode so that the electrical distance between the drain and the source electrode, referred to as the "effective channel length", is less than the physical channel length. When the differential voltage between the drain electrode and the source electrode is increased, the effective channel length is reduced. Because the effective channel length is inversely proportional to the drain current, as the differential voltage between the drain electrode and the source electrode is increases, so does the drain current. That is referred to as channel length modulation, or kink effect. The following illustrates that the influence of kink effect on the pixel.

FIG. 1A is a traditional driving circuit of a pixel of an active matrix organic electroluminescent display. The organic light emitting diode 101 has a cathode connected to a reference voltage generator $V_{SS}$, and an anode connected to a drain electrode of a p-channel thin film transistor 102. The source electrode of the transistor 102 is connected to a display voltage generator $V_{DD}$, and its gate electrode is connected to the gate electrode of another p-channel thin film transistor 103. The gate electrode and the drain electrode of the transistor 103 are connected to a drain electrode and a source electrode of a n-channel thin film transistor 105, respectively. The drain electrode of the transistor 103 is, moreover, connected to the drain electrode of another n-channel thin film transistor 106. The source electrode of the transistor 106 is connected to a data line 107. The transistors 105 and 106 act as switches, and their gate electrodes are connected to the scan line 108 and the data line 109, respectively.

When transistors 105 and 106 are opened, both transistors 102 and 103 act as a current mirror. The current $I_{OLED}$ flowing through the transistor 102 and the organic light emitting diode 101 is dependent on the current $I_{DATA}$ flowing through transistor 103. If the transistors 102 and 103 have the common property, the threshold voltage $V_{tp1}$ of the transistor 103 is equal to the threshold voltage $V_{tp2}$ of the transistor 102. The parameter $\mu_p C_{ox}$ relating to their hole mobility is the same. The gate-source voltage $V_{GS1}$ of the transistor 103 is equal to the gate-source voltage $V_{GS2}$ of the transistor 102. Thus, the relationship is expressed as the equation (1):

$$\frac{I_{OLED}}{I_{DATA}} = \frac{(W/L)_2}{(W/L)_1} \tag{1}$$

Furthermore, if the channel length-width ratio of the transistor 102 is the same as that of the transistor 103, there is an ideal relationship expressed as $I_{OLED}=I_{DATA}$.

When the transistors 105 and 106 are opened, the equivalent circuit is shown as FIG. 1B. After opening the transistor 105, the gate electrode and the drain electrode of the transistor 103 are shorted, expresses as $V_{DS1}=V_{GS1}$.

Considering the influence of the kink effect, a factor $\lambda$ is provided to multiply by the operating voltage $V_{DS}$. If the transistor 102 and transistor 103 have the common property, such as the same $\mu_p C_{ox}$, $V_{tp1}=V_{tp2}$, $V_{GS1}=V_{GS2}$, and $V_{DS1}=V_{GS1}$, then $I_{OLED}$ and $I_{DATA}$ have the relationship expressed as the equation (2):

$$\frac{I_{OLED}}{I_{DATA}} = \frac{(W/L)_2(1+\lambda V_{DS2})}{(W/L)_1(1+\lambda V_{GS1})} \tag{2}$$

Even if the channel length-width ratio of the transistors 102 and 103 are the same, but $V_{DS2} \neq V_{GS1}$, then $I_{OLED} \neq I_{DATA}$.

When the channel length-width ratio W/L is 6/6 in the transistors 102 and 103, the result as FIG. 1C is obtained by simulating the equivalent circuit shown in FIG. 1B. The abscissa is time (sec), and the ordinate is current (A). The line 110 represents the current flowing through the transistor 103, associated with the current $I_{DATA}$ of the data line 107. The line 111 represent the current $I_{OLED}$ flowing through the organic light emitting diode 101. FIG. 1C shows that $I_{OLED}$ is different from $I_{DATA}$ in the current mirror, which is indeed affected by kink effect.

FIG. 1D is $I_D$-$V_{DS}$ curve of a p-type metal oxide semiconductor (PMOS) including the low temperature poly silicon (LTPS). The value of W/L is shown as legend. In an ideal case, it should be horizontal at the right end of each curve, but in FIG. 1D, it turns upward. That illustrates the kink effect is possible to happen in PMOS so as to increase the drain current. Besides, as the PMOS has less physical channel length, its $I_D$-$V_{DS}$ curve is more crooked. That represents it is affected by kink effect more apparently. Likewise, it also happens in an n-type metal oxide semiconductor (NMOS).

For reducing the kink effect, it needs to increase the voltage level of the display voltage generator $V_{DD}$. As shown in FIG. 1D, take the curve of WIL=6/6 as an example, when the operating voltage $V_{DS}$ is larger than 2V, the transistors is operated in the saturation region of the $I_D$-$V_{DS}$ curve. It is observed that they are affected by kink effect, because the slope of the curve is not zero between 2V and 4V. The slope of the curve is approach to zero between 4V and 6V in which the drain current of the transistors is controlled more easily. Therefore, it is necessary to rise the display voltage $V_{DD}$ a little, for example, to increase the operating voltage $V_{DS}$ from 2-4 V to 4-6 V. According to the prior art, $I_{OLED}$ is not still equal to $I_{DATA}$ even if rising the display voltage $V_{DD}$.

SUMMARY OF THE INVENTION

The object of the present invention is to provide a pixel driving circuit, not only preventing the kink effect but also making the current flowing through the light emitting element equal to the data current.

According to the present invention, the pixel driving circuit comprises a current mirror, a switching circuit, a first voltage generator, a second voltage generator and a light emitting element. The current mirror has four transistors. The source electrode of the first transistor is electrically connected to the drain electrode of the second transistor. The gate electrode of the third transistor is electrically connected to the gate electrode of the first transistor. The drain electrode of the forth transistor is electrically connected to the source electrode of the third transistor, and the gate electrode of the forth transistor electrode is electrically connected to the gate electrode and the drain electrode of the second transistor. The first voltage generator is coupled to the source electrodes of the second and forth transistors. The light emitting element has a first electrode coupled to the drain electrode of the first transistor, and a second electrode coupled to the second voltage generator. The switching circuit is electrically connected to the drain electrode and the gate electrode of the third transistor.

The switching circuit employs two scan lines and two transistors to get rid of influence from the feed-through. The light emitting element can be an organic light emitting diode. The voltage difference between the first voltage generator and the second voltage generator is defined as the operating voltage of the pixels. The transistors can be amorphous Si or poly-silicon thin film transistors, but not limited to n-channel or p-channel thin film transistors. In principle, a specific value between the channel length-width ratio of the first transistor and that of the third transistor should be substantially equal to a specific value between the channel length-width ratio of the second transistor and that of the forth transistor.

Comparing with the prior art, the present invention improves the uneven brightness resulting from the threshold voltage drift and the channel length modulation or kink effect. Thus, it is more precise to control the driving current and more efficient to reduce the power consumption of the display panel.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1A:
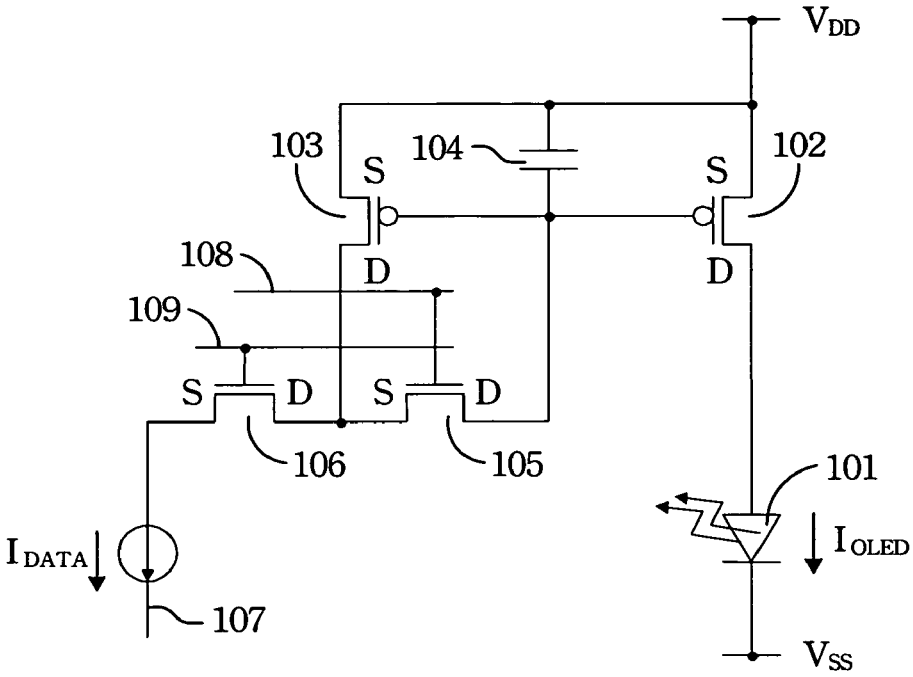
FIG. 1A (Prior Art)
FIG. 1A is a traditional driving circuit of a pixel of an active matrix organic electroluminescent display.
Figure 1B:
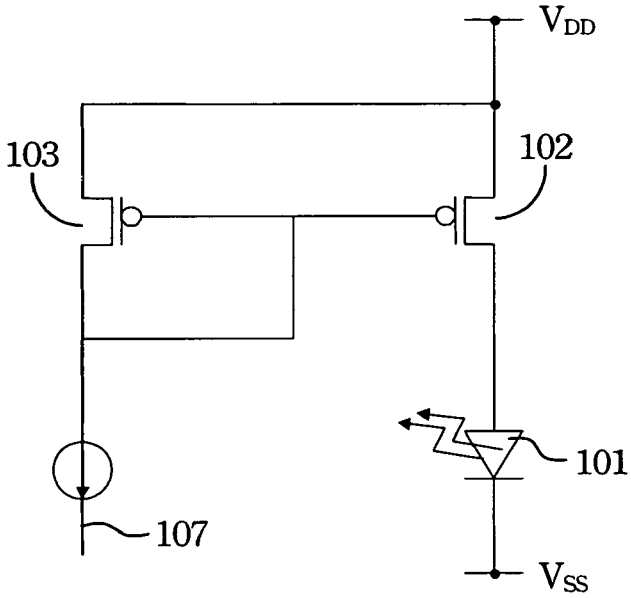
FIG. 1B (Prior Art)
FIG. 1B is a diagram showing an equivalent circuit of FIG. 1A when opening switching transistors.
Figure 1C:
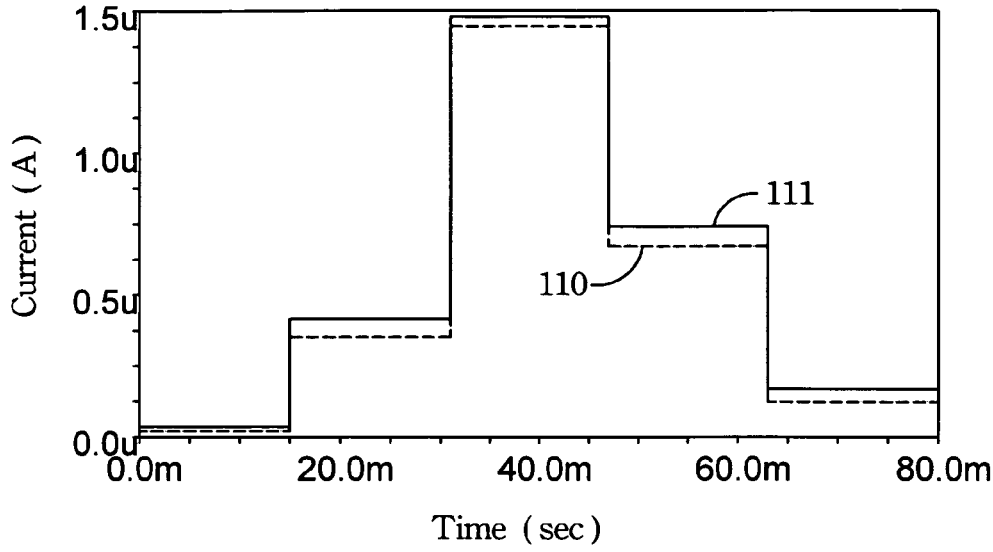
FIG. 1C (Prior Art)
FIG. 1C is a diagram showing the relationship of current versus time for data current and the current flowing through the light emitting element of FIG. 1B.
Figure 1D:
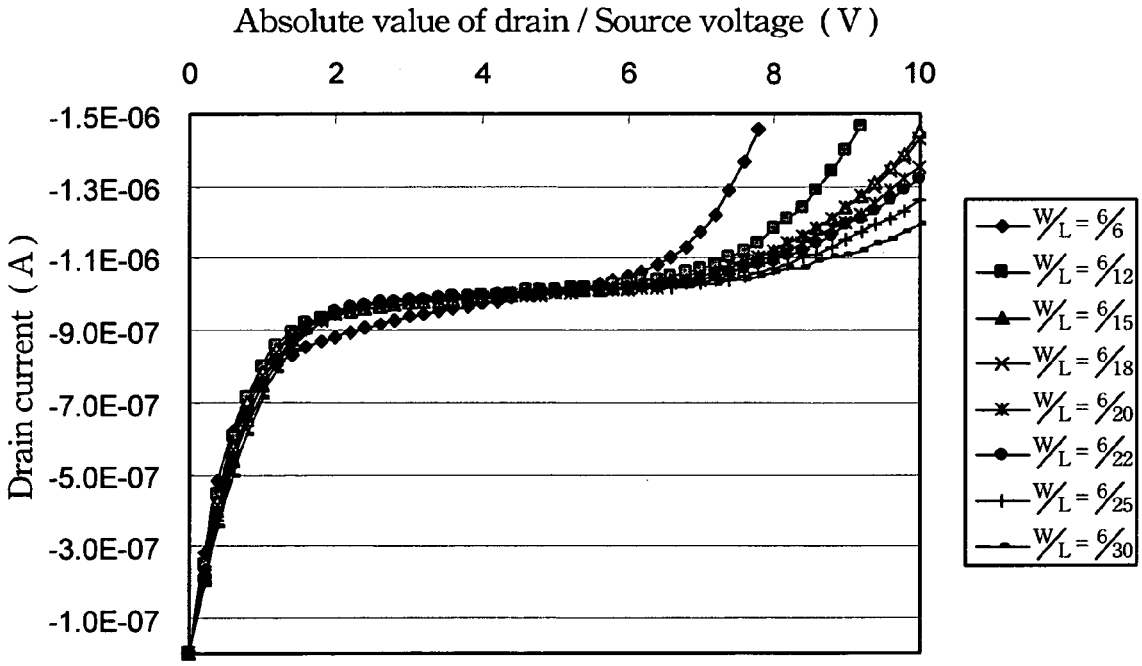
FIG. 1D (Prior Art)
FIG. 1D is a $I_D$-$V_{DS}$ curve of a p-channel MOSFET with LTPS.
Figure 2A:
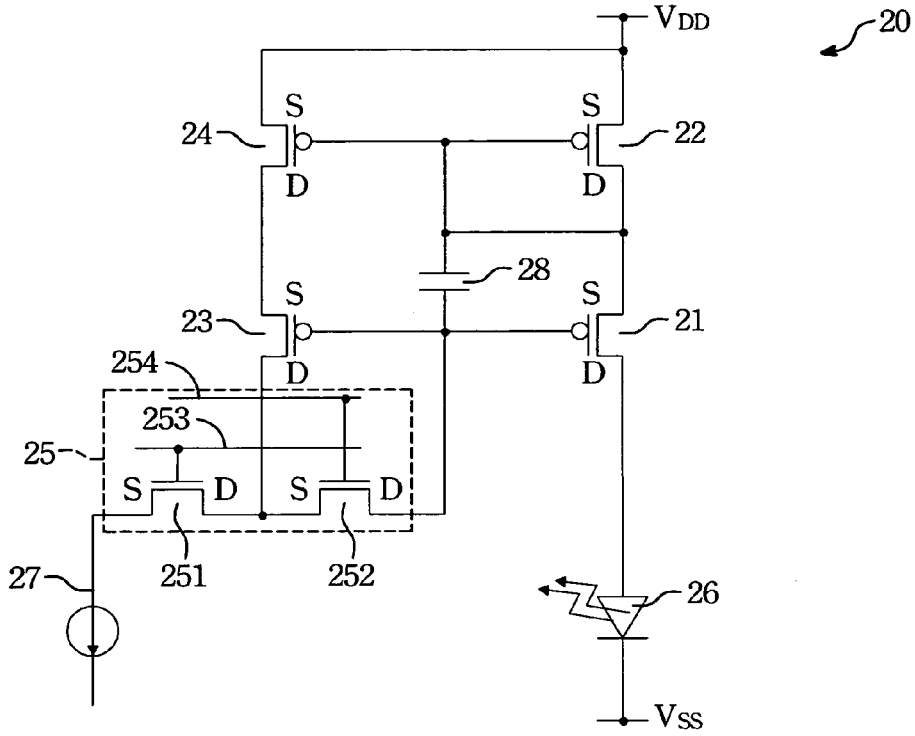
FIG. 2A is a first embodiment of a pixel driving circuit according to the present invention.

Refer to FIG. 2A, the pixel driving circuit 20 has a current mirror comprising four transistors 21, 22, 23 and 24, a display voltage generator $V_{DD}$ and a reference voltage generator $V_{SS}$, a light emitting element 26 and a switching circuit 25. Each of transistors 21, 22, 23 and 24 has a gate electrode, a source electrode, a drain electrode and a channel disposed between the source electrode and the drain electrode.

The current mirror is coupled to the display voltage generator $V_{DD}$ via the transistors 22 and 24 to get a high voltage level. Besides, the current mirror is coupled to one terminal of the light emitting element 26 via the drain electrode of the transistor 21, and connected to the switching circuit 25 via the drain and gate electrodes of the transistor 23, The other terminal of light emitting element 26 is coupled to the reference voltage generator $V_{SS}$ to get a low voltage level. The voltage difference between the display voltage generator $V_{DD}$ and the reference voltage generator $V_{SS}$ is defined as the operating voltage of the pixel. Thus, the data current $I_{DATA}$ of the switching circuit 25 can get rid of the kink effect via the current mirror.

The structure of the circuit mirror is described as follows. The source electrode of the first transistor 21 is electrically connected to the drain electrode of the second transistor 22. The gate electrode of the third transistor 23 is electrically connected to the gate electrode of the first transistor 21. The drain electrode of the forth transistor 24 is electrically connected to the source electrode of the third transistor 23, and the gate electrode of the forth transistor 24 is electrically connected to the gate and the drain electrodes of the second transistor 22. Refer to FIG. 2A, the transistors 21, 22, 23 and 24 are all p-channel thin film transistors. The referent voltage generator $V_{SS}$ has a ground electrode.

For the object of the present invention, the switching circuit 25 employs two scan lines to get rid of influence from the feed-through, because the current change resulting from the feed-through is an indefinite factor. The switching circuit 25 comprises two transistors 251 and 252 and two scan lines 253 and 254. Both the transistors 251 and 252 have a gate electrode, a source electrode and a drain electrode. The gate electrode of the transistor 251 is coupled to the scan line 253, its source electrode is coupled to a data line 27, and its drain electrode is electrically connected to the drain electrode of the transistor 23. The gate electrode of the transistor 252 is coupled to the scan line 254, its source electrode is electrically connected to the drain electrode of the transistor 251, and its drain electrode is coupled to the gate electrodes of the transistor 21 and the transistor 23.

Figure 2B:
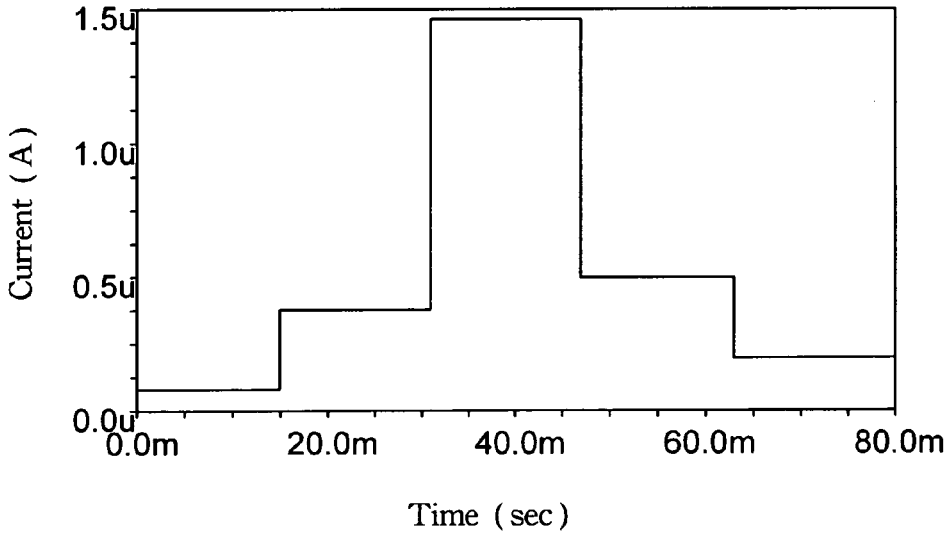
FIG. 2B is a diagram showing the relationship of current versus time for the data current and the current flowing through the light emitting element of FIG. 2A.

FIG. 2B is obtained by simulating the circuit of FIG. 2A. Its abscissa is time (sec), and ordinate is current (A). FIG. 2B shows that the curves of the current $I_{DATA}$ provided by the data line 27, and the current $I_{OLED}$ through the light emitting element 26 overlap. The simulating result shows $I_{DATA}=I_{OLED}$, which illustrates that the current mirror of the present invention is almost never affected by kink effect.

Figure 3A:
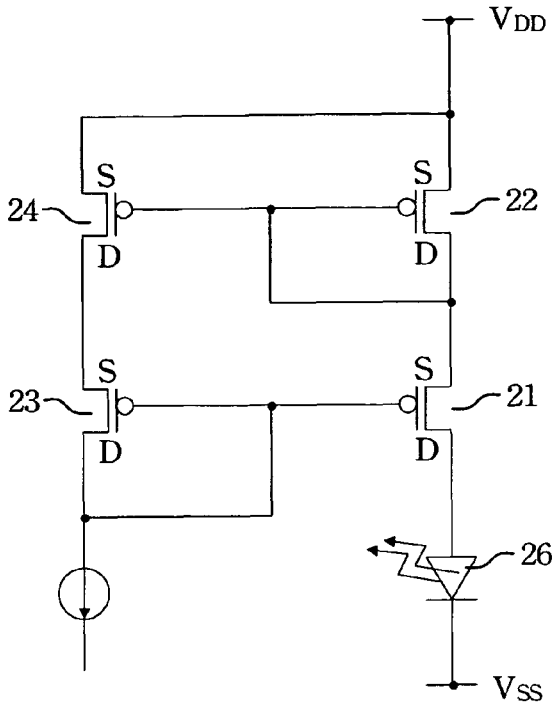
FIG. 3A is a diagram showing an equivalent circuit when opening two transistors of the switching circuit showing in FIG. 2A.

Refer to FIG. 3A, when the transistors 251 and 252 is opened via the scan lines 253 and 254, the relationship between the current $I_{OLED}$ flowing through the light emitting element 26 and the current $I_{DATA}$ is expressed as the equation (3):

$$\frac{I_{OLED}}{I_{DATA}} = \frac{(W/L)_2(1+\lambda V_{GS2})}{(W/L)_4(1+\lambda_{DS4})} \quad (3)$$

In equation (3), $(W/L)_2$ and $(W/L)_4$ represent the channel length-width ratios of the transistors 22 and 24, respectively. $V_{GS2}$ is the gate-source voltage of the transistor 22. $V_{DS4}$ is the drain-source voltage of the transistor 24.

In the circle of the transistors 21, 22, 23 and 24, their voltages have the relationship expressed as equation (4):

$$V_{GS2}=V_{DS4}+V_{GS3}-V_{GS1} \quad (4)$$

In equation (4), $V_{GS3}$ is the gate-source voltage of the transistor 23. $V_{GS1}$ is the gate-source voltage of the transistor 21. According the equations (3) and (4), when the equation (5) is valid, the equation (6) is obtained.

$$\frac{(W/L)_2}{(W/L)_4} = \frac{(W/L)_1}{(W/L)_3} \quad (5)$$

$$V_{GS3} = V_{GS1} \quad (6)$$

The above equation, $(W/L)_1$ and $(W/L)_3$ represent the channel length-width ratios of the transistors 21 and 23, respectively.

The equations (7) and (8) are derived from those above.

$$V_{GS2} = V_{DS4} \quad (7)$$

$$\frac{I_{OLED}}{I_{DATA}} = \frac{(W/L)_2}{(W/L)_4} \quad (8)$$

The conclusion deduced from those above is that, when the specific value between the channel length-width ratio of the transistor 21 and that of the transistor 23 is about equal to the specific value between the channel length-width ratio of the transistor 22 and that of the transistor 24, the current $I_{OLED}$ flowing through the light emitting element 26 is about equal to the data current $I_{DATA}$. Based on above-mentioned, some derived ways are described as follows.

A. The channel length-width ratio of the transistor 21 is about the same as that of the third transistor 23, and the channel length-width ratio of the transistor 22 is about the same as that of the forth transistor 24.

B. All the transistors 21, 22, 23 and 24 have the same channel length-width ratio.

C. All the transistors 21, 22, 23 and 24 have the same channel length and channel width.

Above principle is also adapted to the following embodiments.

Figure 3B:
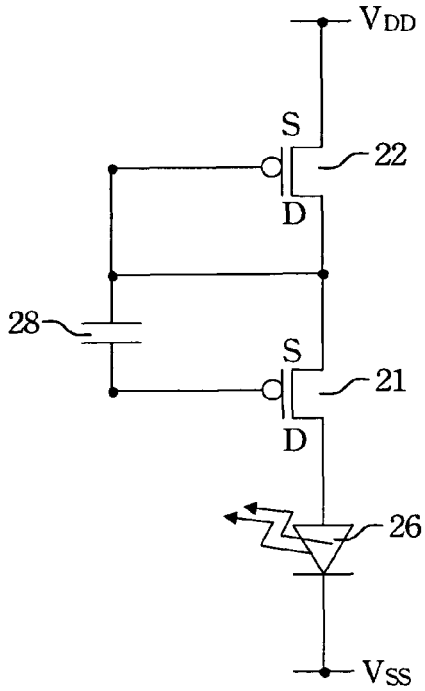
FIG. 3B is a diagram showing an equivalent circuit when closing two transistors of the switching circuit showing in FIG. 2A.

FIG. 3B is an equivalent circuit of FIG. 2A when closing the transistors 251 and 252. A capacitor 28 connects between the source electrode and the gate electrode of the transistor 21. If excluding the influence of feed-through, and closing the transistors 251 and 252 via the scan lines 253 and 254, the voltage cross the capacitor 28 is still equal to $V_{GS1}$. The result is that $I_{DATA}=I_{OLED}$ is valid.

Figure 3C:
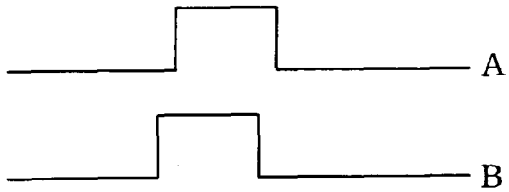
FIG. 3C is a diagram showing time sequence of two scan lines of the switching circuit showing in FIG. 2A.

Refer to FIG. 3C, curve A represents the time sequence of the scan line 253, and curve B represents the time sequence of the scan line 254. The switching circuit 25 can control the opening order of the two transistors 251 and 252 via two scan lines 253, 254. For reducing the feed-through during the pixel acting, the transistor 252 can be closed before or as the transistor 251 closed.

Figure 4:
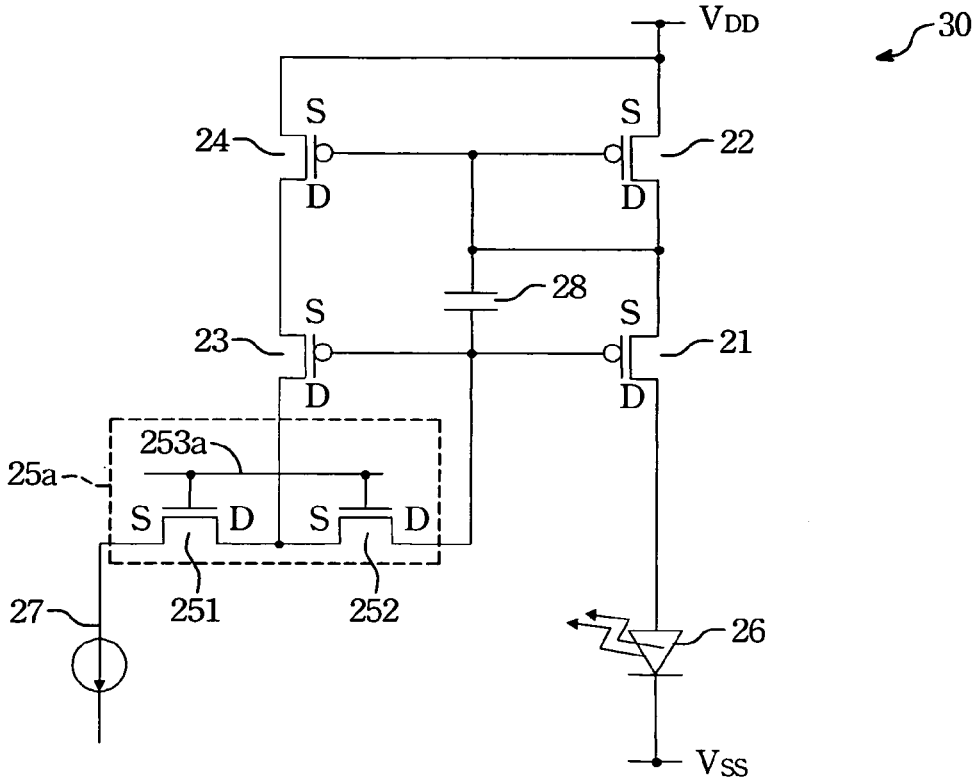
FIG. 4 is a second embodiment about a pixel driving circuit according to the present invention.

Refer to FIG. 4, the switching circuit 25 of FIG. 2A is replaced with the switching circuit 25a. In this embodiment, the drain electrode of the transistor 251 and the source electrode of the transistor 252 are electrically connected to the drain electrode of the transistor 23. The gate electrodes of the transistors 251 and 252 are coupled to the same scan line 253*a*. The source electrode of the transistor 251 is coupled to the data line 27. The drain electrode of the transistor 252 is coupled to the gate electrodes of the transistors 21 and 23.

Figure 5:
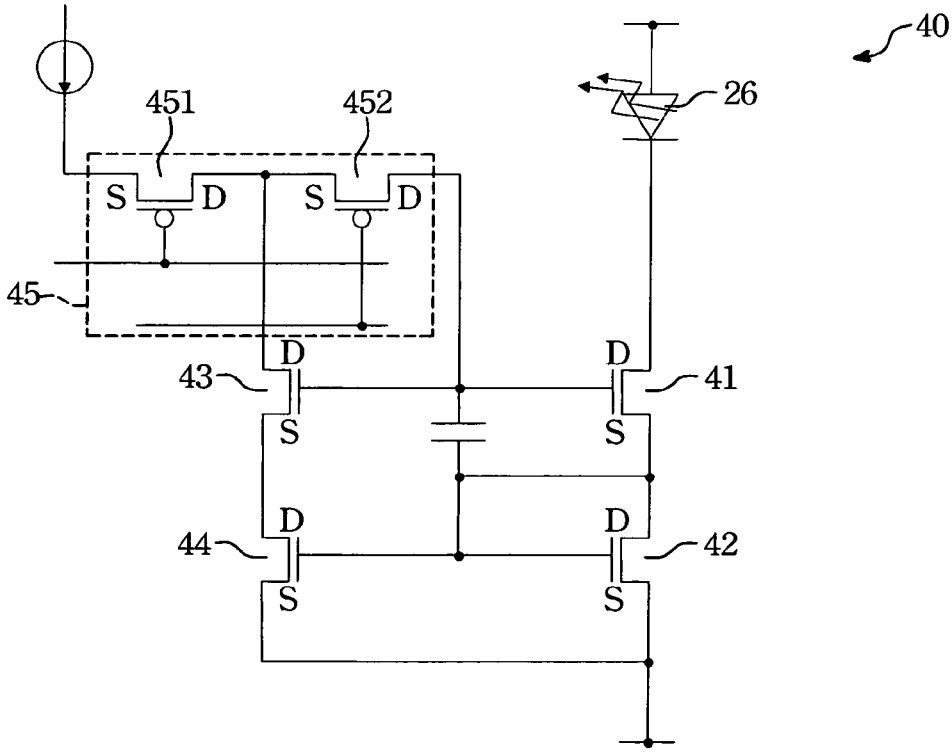
FIG. 5 is a third embodiment about a pixel driving circuit according to the present invention.

Refer to FIG. 5, the current mirror of a driving circuit 40 includes the n-channel thin film transistors 41, 42, 43 and 44. One terminal of the light emitting element 26 is connected to the drain electrode of the transistor 41, and the other terminal is connected to the display voltage generator $V_{DD}$. The source electrodes of the transistors 42 and 44 are connected to the reference voltage generator $V_{SS}$ or the ground electrode. Both the transistors 451 and 452 of the switching circuit 45 are p-channel thin film transistors, which are controlled by two scan lines.

To sum up, the transistors of the current mirror and of the switching circuit are not limited to p-channel or n-channel thin film transistors. In all embodiments, the gate and source electrodes of the transistor, which is connected to the light emitting element, are connected to two terminals of the capacitor, respectively, for example, the transistor 21 shown in FIG. 2A and FIG. 4, the transistor 41 shown in FIG. 5. The above light emitting element can be an organic light emitting diode. The above all transistors can be an amorphous Si or poly-silicon thin film transistor.

Figure 6A:
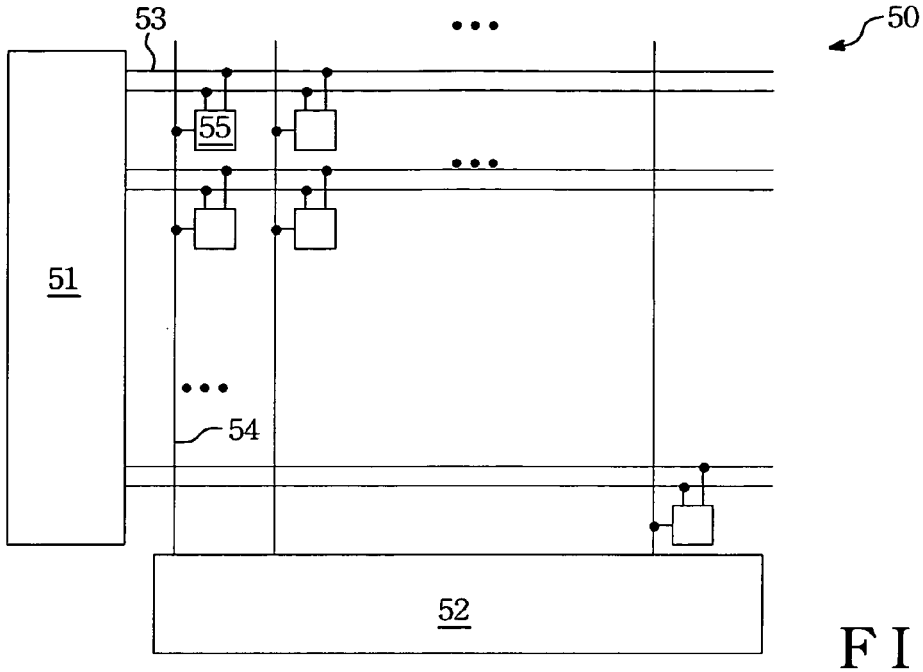
FIG. 6A is an organic electroluminescent display according to the present invention.

Refer to FIG. 6A, the organic electroluminescent display 50 have a scan driver 51 connected to a plurality of scan lines 53, and a data driver 52 connected to a plurality of data lines 54. Each pixel is determined by two scan lines 53 and one data line 54. The driving circuit of the pixel 55 can meet the driving circuit shown in FIG. 2A and FIG. 5.

Figure 6B:
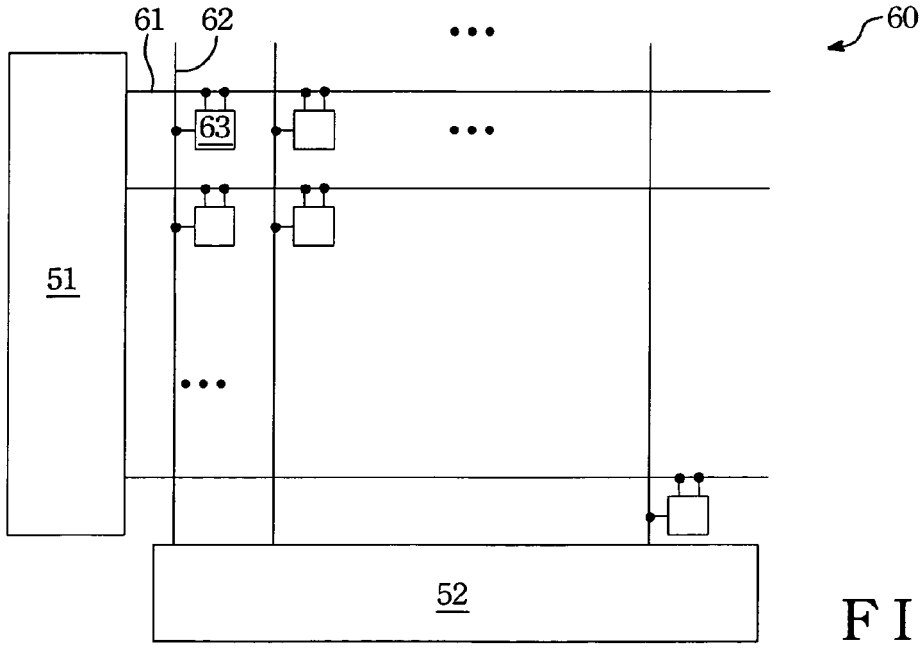
FIG. 6B is another organic electroluminescent display according to the present invention.

Refer to FIG. 6B, in the organic electroluminescent display 60, each pixel 63 is determined by one scan line 61 and one data line 62. Each pixel 63 has two switching transistors, so there are two connection points with the scan line 61, for example, the driving circuit 30 shown in FIG. 4.

Comparing with the prior art, the present invention has advantages as following:

A. improving the uneven brightness resulting from the threshold voltage drift when the excimer laser is employed in LTPS process;

B. improving the channel length modulation so that the driving current is controlled more precisely;

C. reducing the display voltage to operate the TFT in the saturation region, so that it is unnecessary to increase the display voltage to get rid of the kink effect; and D. reducing the difference between the display voltage and the reference voltage to reduce the power consumption of the panel more efficiently.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. A pixel driving circuit, comprising:

a first transistor having a gate electrode, a source electrode, a drain electrode and a channel disposed between the source electrode and the drain electrode;

a second transistor having a gate electrode, a source electrode, a drain electrode and a channel disposed between the source electrode and the drain electrode, wherein the drain electrode of the second transistor is directly connected to the source electrode of the first transistor;

a third transistor having a gate electrode, a source electrode, a drain electrode and a channel disposed between the source electrode and the drain electrode, wherein the gate electrode of the third transistor is electrically connected to the gate of the first transistor;

a fourth transistor having a gate electrode, a source electrode, a drain electrode and a channel disposed between the source electrode and the drain electrode, wherein the drain electrode of the fourth transistor is electrically connected to the source of the third transistor, and the gate electrode of the fourth transistor is always directly connected to the gate electrode and the drain electrode of the second transistor;

a light emitting element having a first electrode and a second electrode, wherein the first electrode is directly connected to the drain electrode of the first transistor;

a first voltage generator coupled to the source electrodes of the second transistor and of the fourth transistor;

a second voltage generator coupled to the second electrode of the light emitting element;

a switching circuit electrically connected to the drain electrode and the gate electrode of the third transistor; and a capacitor having two ends directly connected to the gate electrode and the source electrode of the first transistor, respectively.

* * * * *